US006116359A

United States Patent [19]

Prejean

[11] Patent Number: 6,116,359

[45] Date of Patent: Sep. 12, 2000

[54] TRI-CONE KERF GAGE

[75] Inventor: John Saul Prejean, Arlington, Tex.

[73] Assignee: Baker Hughes Inc., Houston, Tex.

[21] Appl. No.: 09/221,529

[22] Filed: Dec. 28, 1998

Related U.S. Application Data

[63] Continuation-in-part of application No. 08/819,125, Mar. 17, 1997, abandoned.

[51] Int. Cl.[7] ..... E21B 10/12; E21B 10/16

[52] U.S. Cl. ..... 175/341; 175/374; 175/426; 175/432

[58] Field of Search ..... 175/331, 341, 175/365, 37 F, 378, 426, 420.1, 432

[56] References Cited

U.S. PATENT DOCUMENTS

| | | | |
|---|---|---|---|
| 2,774,570 | 12/1956 | Cunningham . | |
| 2,774,571 | 12/1956 | Morlan . | |
| 2,927,777 | 3/1960 | Steen . | |
| 2,927,778 | 3/1960 | Coulter, Jr. . | |
| 2,990,025 | 6/1961 | Talbert et al. . | |
| 3,126,067 | 3/1964 | Schumacher, Jr. . | |
| 3,385,385 | 5/1968 | Kucera et al. . | |
| 3,442,342 | 5/1969 | McElya et al. . | |
| 3,679,009 | 7/1972 | Goodfellow . | |
| 4,716,977 | 1/1988 | Huffstutler . | |
| 5,145,016 | 9/1992 | Estes . | |
| 5,323,865 | 6/1994 | Isbell et al. . | |
| 5,351,768 | 10/1994 | Scott et al. . | |
| 5,353,885 | 10/1994 | Hooper et al. . | |
| 5,407,022 | 4/1995 | Scott et al. . | |
| 5,697,462 | 12/1997 | Grimes et al. . | |
| 5,755,301 | 5/1998 | Love et al. | 175/426 |
| 5,785,135 | 7/1998 | Crawley | 175/373 |

*Primary Examiner*—Roger Schoeppel
*Attorney, Agent, or Firm*—Felsman, Bradley, Vaden, Gunter & Dillon, L.L.P.; James E. Bradley

[57] ABSTRACT

An earth-boring bit has a bit body with at least one bearing shaft depending inwardly and downwardly therefrom. A cutter is mounted for rotation on each bearing shaft and has a cutter shell surface and a plurality of cutting elements arranged on the shell surface in generally circumferential rows. A pair of surfaces extends from the cutter shell surface on opposing sides of one of the circumferential rows of cutting elements. The pair of surfaces converge together to define a kerf crest that is oriented transversely to the axis of rotation of the cutter. The kerf crest projects from the cutter shell surface by an amount less than the cutting elements in the kerf row having the kerf crest.

12 Claims, 3 Drawing Sheets

TRI-CONE KERF GAGE

This application is a continuation-in-part of application Ser. No. 08/819,125, filed MAR. 17, 1997 now abandoned

FIELD OF THE INVENTION

The present invention relates generally to earth-boring bits of the rolling cutter variety. More specifically, the present invention relates to the cutting structure of earth-boring bits of the rolling cutter for mining applications, principally drilling blast holes for recovery of minerals.

BACKGROUND INFORMATION

Prior to the advent of the rolling-cone earth-boring bit, bores and boreholes in earthen formations typically were formed with a cable tool or a fixed-cutter drag bit. These early bits were little more than chisels forced into the earth by various means. By comparison the original rolling-cone rock bit invented by Howard R. Hughes, U.S. Pat. No. 939,759, drilled the hard caprock at the Spindletop field near Beaumont, Texas with relative ease. This rolling-cone bit was a nearessential part of the drilling and production of oil and gas wells that has propelled the energy industry.

Earth-boring or rock bits of the rolling-cutter variety are also useful in penetrating earthen formations for purposes other than the production of petroleum. These applications generally are referred to as "mining" applications. A principal mining application for mining bits is the drilling of blast holes. Blast holes are relatively shallow (compared to those drilled for production of petroleum) holes in the earth that are used for a variety of purposes, but primarily to insert explosives into the earth for opening subterranean mine cavities.

Rock bits employed in drilling for petroleum generally are run until they are effectively destroyed.

Rock bits employed in mining applications generally are not, and may be used to bore or drill more than one hole. Generally, the equipment employed in oil and gas well drilling is more expensive and more expensive to operate than that used in mining operations. Thus, there is a perception that the operational life of a rolling-cone rock bit employed in petroleum drilling applications is more critical factor than the life of a rock bit employed in mining applications.

Nevertheless, the basic measure of the performance of a rolling-cone rock bit, whether for mining or petroleum drilling applications, is its rate of penetration of earthen formations. A bit that has a long operational life, but drills slowly, has a poor penetration rate, as does a bit that drills quickly, but has a short operational life. Thus, penetration rate measures both the durability and the drilling efficiency of a rock bit.

Many factors affect the penetration rate of a rock bit. One of these factors is the bit's cutting structure, which includes the configuration and arrangement of cutting elements or teeth on the cutters of the bit. For example, bits having steel teeth, milled or formed from the material of the cutter, have generally good toughness and sharpness and are thus useful in drilling relatively soft formations such as clays, shales, soft sandstones and limestones.

For increased durability, the cutting elements are also formed of hard metal inserts or compacts, usually sintered tungsten carbide, which are interference fit or otherwise secured into apertures in the cutter. These carbide cutting elements are more blunt and have lower projections than steel teeth, and thus are adapted for drilling harder formations such as metal ores and igneous rocks.

In addition to the composition of the cutting elements, their individual configurations and arrangement on each cutter can influence the penetration rate of a bit. There is a near-constant need for improvements to the cutting structure of earth-boring bits, for both mining and petroleum drilling applications.

SUMMARY OF INVENTION

It is a general object of the present invention to provide an earth-boring bit of the rolling-cutter variety having an improved cutting structure. This and other objects of the present invention are achieved by providing a bit body having at least one bearing shaft depending inwardly and downwardly therefrom. A cutter is mounted for rotation on each bearing shaft and has a cutter shell surface and a plurality of cutting elements arranged on the shell surface in generally circumferential rows. A pair of surfaces extend from the cutter shell surface on opposing sides of one of the circumferential rows of cutting elements. The pair of surfaces converge together to define a kerf crest that is oriented transversely to the axis of rotation of the cutter. The kerf crest projects from the cutter shell surface by an amount less than the cutting elements in the kerf row having the kerf crest.

According to the preferred embodiment of the present invention, the cutting elements are formed of hard metal and are secured by interference fit in apertures in the cutter.

According to the preferred embodiment of the present invention, the cutting elements in the circumferential row with the kerf crest are chisel-shaped and have their crests generally aligned with the kerf crest.

According to the preferred embodiment of the present invention, the pair of opposing surfaces are contoured to conform with the cutting elements in the circumferential row having the kerf crest.

According to the preferred embodiment of the present invention, the kerf crests are provided in the heel row of a cutter.

Other objects, features, and advantages of the present invention become apparent with reference to the figures and detailed description, which follow.

DESCRIPTION OF THE PREFERRED EMBODIMENT

Figure 1:
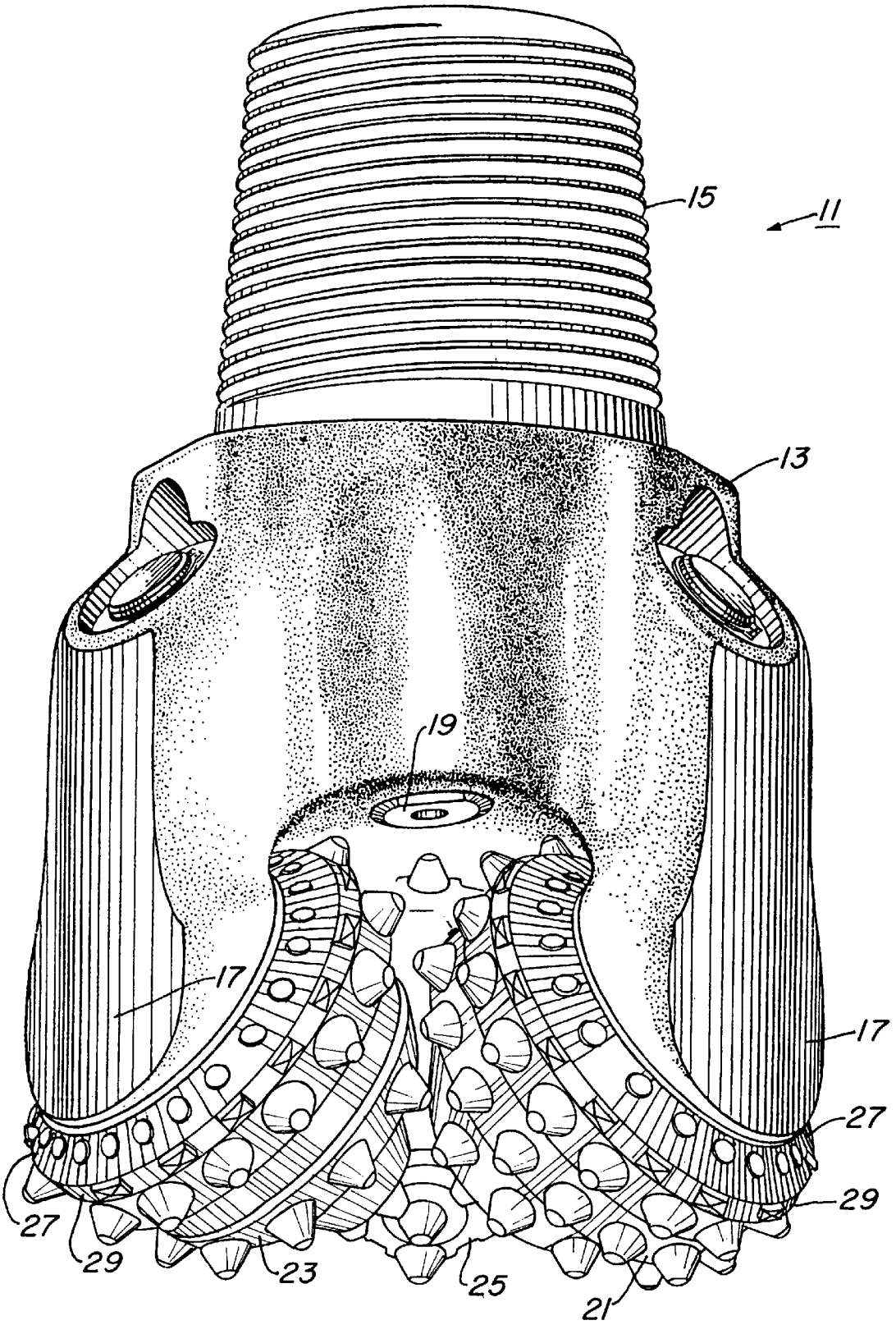
FIG. 1 is a perspective view of an earth-boring bit according to the present invention.

FIG. 1 is a perspective view of an earth-boring bit 11 according to the preferred embodiment of the present invention. Bit 11 has a bit body 13, which is threaded at its upper extent 15 for connection into a drillstring. Two or preferably three bit legs 17 depend downwardly from bit body 13. A bearing shaft (not shown) depends inwardly and downwardly from each bit leg 17 and bit body 13.

At least one nozzle 19 is provided in bit body 13 to deliver a stream of drilling fluid (usually air in mining applications) to the bottom of the borehole to cool bit 11 and to carry cuttings up the borehole. A generally frusto-conical cutter 21, 23, 25 is mounted for rotation on each bearing shaft. Each cutter 21, 23, 25 is conventionally offset such that its axis of rotation does not coincide with the geometric center of bit 11. Offset cutters slide as well as roll over the bottom of the borehole.

Each cutter 21, 23, 25 has a cutter shell surface that includes an outermost or gage surface 27 and a heel surface 29 that is just inward of gage surface 27. A plurality of cutting elements 28, preferably hard metal inserts or compacts, are interference pressed into apertures arranged in circumferential rows on each cutter 21, 23, 25. Cutting elements 28 are conical in the embodiment shown, but may be other shapes. The circumferential rows include a gage row of elements on gage surfaces 27 and a heel row of kerf ring elements 31 on heel surfaces 29.

Figure 2:
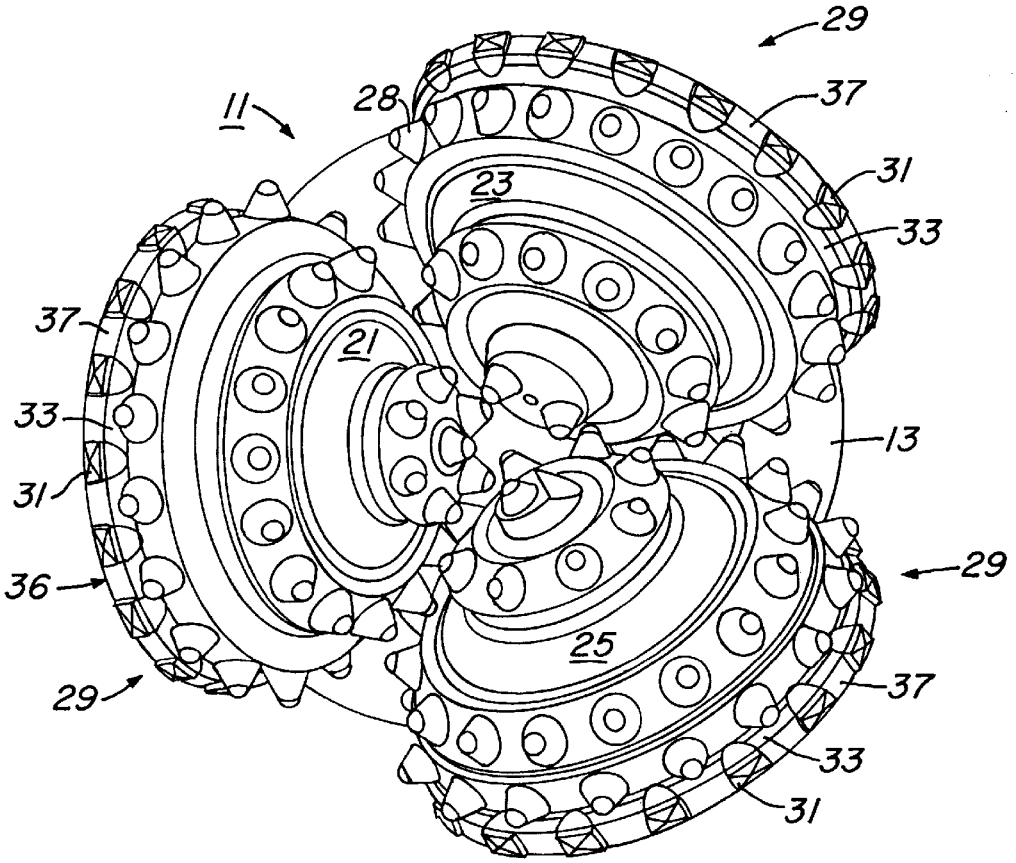
FIG. 2 is a perspective view, looking upwardly, of the cutters of the earth-boring bit of FIG. 1.

FIG. 2 is a perspective view, looking upwardly toward cutters 21, 23, 25, of bit 11 according to the present invention. In FIG. 2, the circumferential rows of cutting elements are more easily seen. A plurality of chisel-shaped cutting elements 31, having their crests oriented transversely (circumferentially) to the axis of rotation of each cutter, are arranged in circumferential rows on heel surfaces 29 of each cutter 21, 23, 25. According to the preferred embodiment of the present invention, chisel-shaped inserts 31 are formed of sintered tungsten carbide and are secured by interference fit into apertures formed in the cutter shell surface of each cutter 21, 23, 25.

Figure 3:
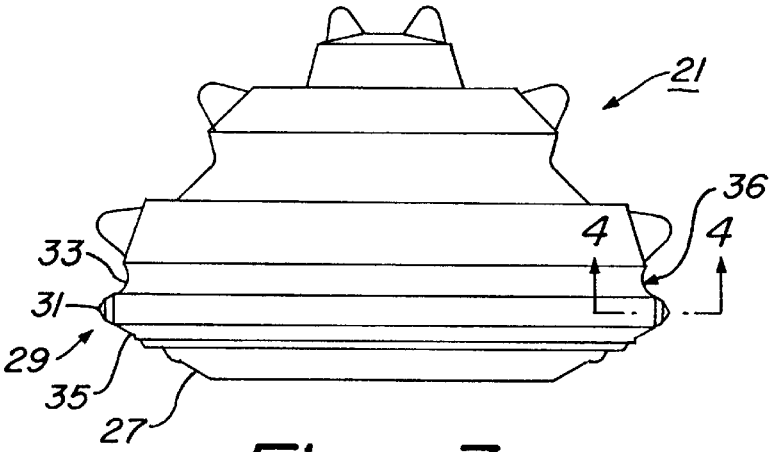
FIG. 3 is an elevation view of a single cutter of the earth-boring bit of FIG. 1.

As better seen in the elevation view of a cutter 21 in FIG. 3, a pair of kerf-row surfaces 33, 35 on opposing sides of the heel row of cutting elements 31 converge from the cutter shell surface of the heel row to define a kerf ring 36 having a kerf crest 37. The cutting kerf ring elements 31 are the primary cutting structure on kerf ring 36. The kerf ring inserts 31, opposing kerf-row surfaces 33, 35, and kerf crests 37 combine to define a kerf row on each cutter 21, 23, 25. According to the preferred embodiment of the present invention, the kerf row is on the heel surface 29 or in the heel row of each cutter. Nevertheless, the kerf row may find application in inner rows as well.

Figure 4:
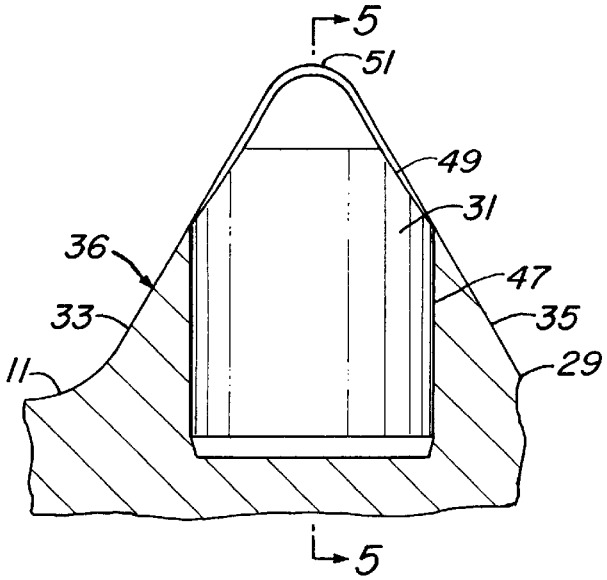
FIG. 4 is an enlarged sectional view of a portion of the cutter of FIG. 3, taken along the line 4—4 of FIG. 3, and showing a kerf ring insert.
Figure 5:
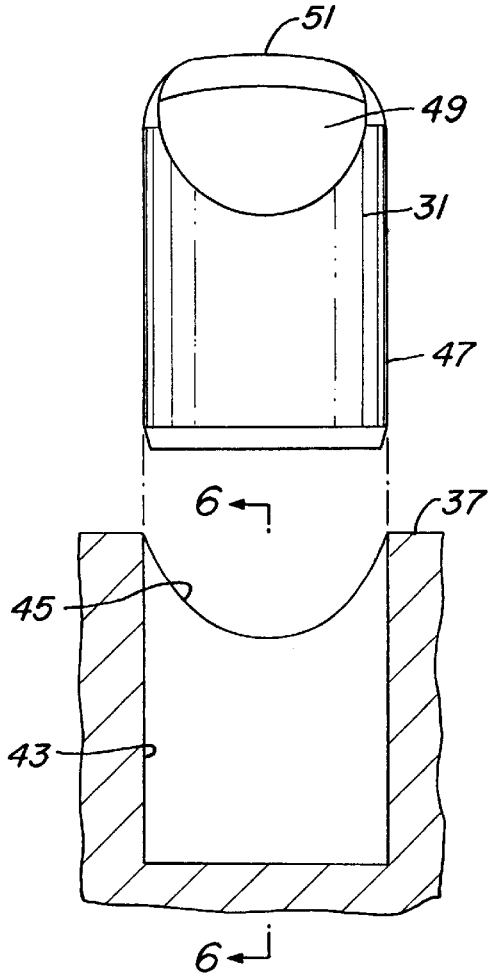
FIG. 5 is a partial sectional and exploded view of the kerf ring insert of FIG. 4, taken along the line 5—5 of FIG. 4.
Figure 6:
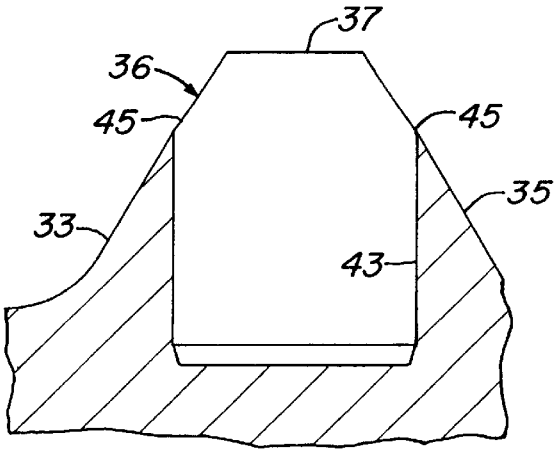
FIG. 6 is a sectional view of a portion of the kerf ring as shown in FIG. 5, taken along the line 6—6 of FIG. 5 and not showing the kerf ring insert.

FIGS. 4–7 are enlarged views illustrating kerf ring 36 and kerf ring elements 49. Referring to FIG. 4, annular surfaces 33, 35 converge at a selected angle of convergence toward each other. Annular surfaces 33, 35 terminate in a crest 37 that is substantially flat when viewed in cross-section. Inner annular surface 33 has a generally concave base 41, which is located between kerf ring 36 and the outermost row of cutting elements 28.

A plurality of holes 43 are formed in kerf ring 36 for receiving kerf ring elements 31. Each hole 43 is cylindrical with a closed base. The diameter of each hole 43 is greater than the width of kerf crest 37.

Consequently, when each hole 43 is drilled, it will form scalloped-shaped openings 45 on the inner and outer annular surfaces 33, 35 where the hole 43 intersects annular surfaces 33, 35. Openings 45 are semi-circular and extend below kerf crest 37.

Figure 7:
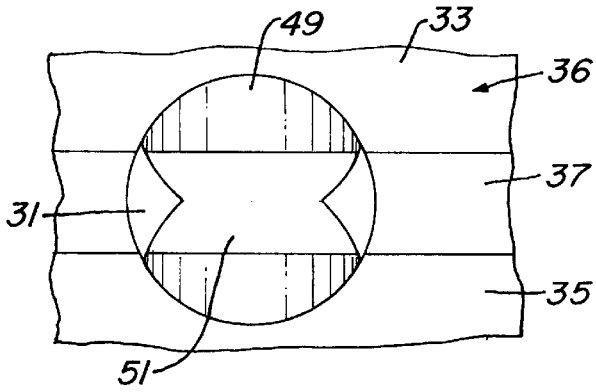
FIG. 7 is a top view of the kerf ring insert shown in FIGS. 4 and 5.

Each kerf ring cutting element 31 has a cylindrical base 47 which is interferingly secured within one of the holes 43. A cutting end protrudes from base 47, the cutting end being generally chisel-shaped. The cutting end has a pair of inner and outer generally flat flanks 49 which converge toward each other at the same angle of convergence as annular surfaces 33, 35, as shown in FIG. 4. A portion of each flank 49 will locate within one of the scalloped-shaped openings 45. This places flanks 49 substantially flush with annular surfaces 33, 35. A portion of each flank 49 will be located below kerf crest 37, while the crest 51 of each kerf ring element 31 protrudes above kerf ring crest 37. Scalloped-shaped openings 45 expose the portion of flanks 49 below kerf crest 37 and provide a smooth contour to annular surfaces 33, 35. Kerf element crest 51 has substantially the same width as kerf ring crest 37, as shown in FIG. 7. Kerf element crest 51 is elongated and aligned generally with kerf ring crest 37, transverse to the axis of rotation of each cutter 21, 23, 25.

In operation, bit 11 is coupled into a drillstring, and is rotated such that cutters 21, 23, 25 roll and slide over the bottom of the borehole. The action of cutters 21, 23, 25 and cutting elements 28, 31 on the bottom of the borehole crushes, shears, and otherwise dislodges formation material, which is carried up the annulus between the drillstring and the borehole wall. The combination of kerf crest 37 and transversely oriented chisel-shaped inserts 31 kerfs the bottom of the borehole. The extra cutter material provided by opposing kerf row surfaces 33, 35 aids in retention of the cutting elements and provides a heel cutting structure in the event some kerf row cutting elements 31 are lost. The combination of transversely oriented chisel-shaped inserts 31 with kerf crest 37 also aids in maintenance of the gage or diameter of the borehole.

The present invention is described with reference to a preferred embodiment thereof. It is not limited, but is thus susceptible to variation and modification without departing from the scope of the invention.

I Claim:

1. An earth-boring bit comprising:

a bit body;

at least one bearing shaft depending inwardly and downwardly from the bit body;

a cutter mounted for rotation on each bearing shaft, the cutter having a cutter shell surface and a plurality of cutting elements arranged in circumferential rows on the cutter;

a pair of annular surfaces extending from the cutter shell surface and converging toward each other to define a kerf ring which has a kerf crest; and a plurality of kerf ring elements located in holes formed in the kerf ring and protruding from the kerf crest, the kerf ring elements having inner and outer flanks which converge toward each other at substantially the same angles of convergence as the annular surfaces, a portion of each of the flanks extending below the kerf crest and being substantially flush with one of the annular surfaces.

2. The bit according to claim 1, wherein each of the holes has a diameter greater than a width of the kerf crest.

3. The bit according to claim 1, wherein each of the holes intersects each of the annular surfaces at a point below the kerf crest, forming semi-circular openings.

4. The bit according to claim 1, wherein each of the kerf ring elements has a crest which is aligned with the kerf crest.

5. The bit according to claim 1, wherein the kerf ring elements are formed of hard metal and are secured by interference fit in the holes in the kerf ring.

6. An earth-boring bit comprising:

a bit body;

at least a pair of bearing shafts depending inwardly and downwardly from the bit body;

a cutter mounted for rotation on each bearing shaft, the cutter having a cutter shell surface and a plurality of cutting elements arranged in circumferential rows on the cutter;

inner and outer annular surfaces extending from the cutter shell surface and converging toward each other to define an annular kerf ring having a kerf crest oriented transversely to the axis of rotation of the cutter, the kerf ring having a plurality of holes, each of which has a diameter greater than a width of the kerf crest, defining scalloped-shaped openings on the inner and outer annular surfaces; and a plurality of kerf ring elements, each having a cylindrical base secured in one of the holes in the kerf ring, the kerf ring elements being chisel-shaped, having a cutting element portion protruding from the base with inner and outer sides which are substantially flat and converge toward each other, the kerf ring elements having crests aligned generally transverse to the axis of rotation of the cutter, wherein a portion of the inner and outer sides of the kerf ring elements fit substantially flush with the inner and outer annular surfaces within the scalloped-shaped openings.

7. The bit according to claim 6, wherein the crests of the kerf ring elements are substantially the same width as the kerf crest.

8. The bit according to claim 6, wherein the crests of the kerf ring elements protrude past the kerf crest.

9. The bit according to claim 6, wherein the inner and outer annular surfaces converge toward each other at an angle of convergence which is substantially the same as an angle of convergence of the kerf ring elements.

10. The bit according to claim 6, wherein the cutting elements are formed of hard metal and are secured by interference fit in apertures in the cutter.

11. The bit according to claim 6, wherein the kerf ring elements are formed of hard metal and are secured by interference fit in the holes in the kerf ring.

12. An earth-boring bit comprising:

a bit body;

at least a pair of bearing shafts depending inwardly and downwardly from the bit body;

a cutter mounted for rotation on each bearing shaft, the cutter having a cutter shell surface and a plurality of hard metal cutting elements secured by interference fit within apertures arranged in circumferential rows on the cutter;

inner and outer annular surfaces extending from the cutter shell surface and converging toward each other at a selected angle of convergence to define an annular kerf ring on a heel surface of the cutter, the kerf ring having a kerf crest oriented transversely to the axis of rotation of the cutter;

a plurality of holes formed in the kerf ring, each of which has a diameter greater than a width of the kerf crest, defining scalloped-shaped openings on the inner and outer annular surfaces; and a plurality of kerf ring elements, each having a cylindrical base secured in one of the holes in the kerf ring, the kerf ring elements being chisel-shaped, having a cutting element portion protruding from the base with inner and outer flanks which are substantially flat and converge toward each other at an angle of convergence which is substantially the same as the angle of convergence of the kerf ring, the kerf ring elements having crests aligned generally transversely to the axis of rotation of the cutter and protruding past the kerf crest, the crests of the kerf ring elements being substantially the same width as the kerf crest, wherein a portion of the inner and outer sides of the kerf ring elements fit substantially flush with the inner and outer annular surfaces within the scalloped-shaped openings.

* * * * *